United States Patent [19]

Yamaoka et al.

[11] Patent Number: 4,888,993

[45] Date of Patent: Dec. 26, 1989

[54] APPARATUS FOR MEASURING REDUCTION RATIO OF ROLLED MATERIAL

[75] Inventors: Masayoshi Yamaoka; Kiyomi Tsutsui, both of Kitakyushu; Tadashi Inoue, Noogata; Toyoki Takahashi, Kitakyushu, all of Japan

[73] Assignee: Nippon Steel Corporation, Tokyo, Japan

[21] Appl. No.: 251,227

[22] PCT Filed: Oct. 16, 1987

[86] PCT No.: PCT/JP87/00794

§ 371 Date: Jun. 10, 1988

§ 102(e) Date: Jun. 10, 1988

[87] PCT Pub. No.: WO88/02669

PCT Pub. Date: Apr. 21, 1988

[30] Foreign Application Priority Data

Oct. 17, 1986 [JP] Japan ..... 61-248216

[51] Int. Cl.[4] ..... G01N 3/00

[52] U.S. Cl. ..... 73/760; 73/159

[58] Field of Search ..... 73/760, 159, 199, 760; 364/563, 508

[56] References Cited

FOREIGN PATENT DOCUMENTS

| | | | |
|---|---|---|---|
| 0069273 | 1/1983 | European Pat. Off. . | |
| 2217423 | 10/1973 | Fed. Rep. of Germany . | |
| 1296207 | 5/1962 | France . | |
| 2466746 | 4/1981 | France . | |
| 179626 | 9/1985 | Japan | 73/760 |

*Primary Examiner*—Jerry W. Myracle

*Attorney, Agent, or Firm*—Spencer & Frank

[57] ABSTRACT

In an apparatus for determining the reduction ratio of a rolled material by measuring the moving speed of a magnetic mark formed on a strip on the inlet and outlet sides of a rolling mill, a rising of a signal of the logical product of a detection signal on the inlet side and a pulse of a gate which is opened by a magnetic mark detection signal on the outlet side and is closed after the lapse of an optimum time is adopted as the timing for detection of the magnetic mark on the inlet side, and the comparison levels of the detectors are automatically changed according to the stored magnitude of the magnetic mark, whereby a worsening of the S/N ratio of the magnetic mark signal on the inlet side or an erroneous detection is reduced.

7 Claims, 5 Drawing Sheets

APPARATUS FOR MEASURING REDUCTION RATIO OF ROLLED MATERIAL

TECHNICAL FIELD

The present invention relates to a non-contact type apparatus for the measurement of a reduction ratio during the rolling of a steel sheet or the like.

BACKGROUND ART

The reduction ratio of a rolled material can be computed from the speed of movement of the material before and after the rolling. As a means for measuring the speeds of movement of the material before and after the rolling, a contact type apparatus was often adopted in which measuring rolls or other measuring devices were brought in contact with strip coils on the inlet and outlet sides. However, recently, since the rolling speed has greatly increased and the necessity for a wet rolling using water or oil because of high-pressure operation has increased, the problem of a reduction of the measurement precision due to slip page has become serious, and therefore, a non-contact type apparatus in which magnetic marks are formed on the inlet and outlet sides and these marks are inspected in a non-contact manner has been developed. Apparatuses of this type are disclosed in Japanese Examined Utility Model No. 43-29667 and Japanese Unexamined Patent Publication No. 55-94711.

Japanese Examined Utility Model Publication No. 43-29667 discloses a basic apparatus in which the speed of movement of a magnetic mark on a material is measured before or after rolling. However, this apparatus is defective in that, when the material is moved at a high speed, a delay in operation occurs in either a magnetizer or a detector and an offset error inherent to the rolling operation cannot be avoided. As a means for overcoming this defect, the applicant of the instant application developed and proposed the measurement apparatus disclosed in Japanese Unexamined Patent Publication No. 55-94711. However, when this apparatus was put to practical use, it was found that this apparatus still leaves problems to be solved. Namely, in the actual rolling operation, since the material has a property such that the hardness on the inlet side is lower than the hardness on the outlet side, the intensity of the magnetic mark is proportionally reduced, and an erroneous operation is readily caused by noise, especially in the case of a soft material such as low-carbon steel for use in deep drawing, for which the demand has recently increased. Moreover, since the material on the inlet side is softer than on the outlet side and local deformation is readily caused by the winding motion of the roll through its travel, the gap, between the material and the detector is changed, which generates noise and worsens the S/N ratio, and in this case, of the comparison level of the detector is fixed, the error in the detection is enlarged.

It is an object of the present invention to provide a measurement apparatus in which the problems of the apparatus disclosed in Japanese Unexamined Patent Publication No. 55-94711 are solved and the reduction ratio can be precisely measured irrespective of the kind of material to be rolled.

SUMMARY OF THE INVENTION

The object of the present invention is attained by an apparatus for measuring the reduction ratio of a rolled material, which comprises magnetizers disposed on the inlet and outlet sides of a rolling mill to form a magnetic mark on a material to be rolled and detectors coupled with the magnetizers and spaced from the corresponding magnetizers by a certain distance, wherein the reduction ratio is computed from the speed of movement of the material on the inlet and outlet sides, the apparatus being characterized in that the apparatus further comprises a gate which is opened by a detection signal from the detector on the outlet side and is closed after an optimum time determined by the line speed and the set range of the reduction ratio, the rising of the signal after sampling of the logical product of the gate signal and the detection signal on the inlet side is adopted as the timing for detection of the magnetic mark on the inlet side, and between the respective coupled magnetizers and detectors on the inlet and outlet sides, the magnitudes of the magnetic marks are stored and during the non-magnetization period for computation of the reduction ratio, the comparison levels of the detectors are automatically changed.

From the viewpoint of controllability of the rolling mill, preferably the time interval for the output of the reduction ratio values is constant and a maximum number of samples is collected under this condition. In the apparatus of the present invention, therefore, a method is adopted in which the present line speed is read in a CPU, a maximum number of samples that can be collected during the output time interval is computed, and the measurement precision and controllability of the rolling mill are reconciled.

The present invention will now be described with reference to the accompanying drawings.

BEST MODE FOR CARRYING OUT THE INVENTION

The principle of the present invention will now be described with reference to FIG. 1, while comparing the present invention with the conventional technique.

Figure 1:
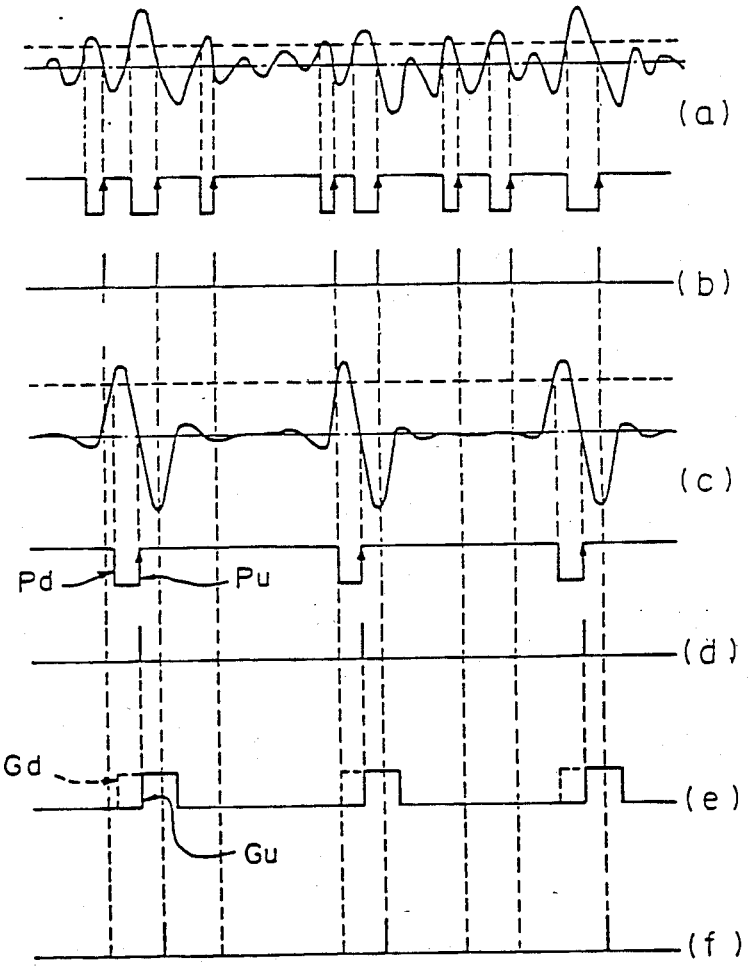
FIG. 1 is a diagram illustrating the states of detection pulses in the conventional apparatus and the apparatus of the present invention.

The first characteristic feature of the present invention is that a worsening of the S/N ratio of the magnetic mark signal on the inlet side, as shown in FIG. 1-(*a*) or an erroneous detection, is reduced as much as possible. Namely, because of the irregular and rough surface of a material to be rolled, the magnetic mark signal on the inlet side ordinarily has a complicated wave form including many peaks and troughs, as shown in FIG. 1-(*a*). If this signal is detected above a certain comparison level which refers to a standard level to be compared with the level of the detected signal a plurality of detection pulses are obtained, as shown in FIG. 1-(*b*), resulting in an erroneous detection.

On the other hand, the magnetic mark signal on the outlet side has a large absolute value and a simple wave form, as shown in FIG. 1-(*c*), because the material has been uniformly surface-processed and hardened and the surface has been smoothened. Accordingly, a detection pulse obtained by detecting this signal above a certain comparison level has one rising, as shown in FIG. 1-(*d*), and no erroneous detection is caused. In the apparatus of the present invention, since the distance between the coupled magnetizer and detector on the inlet side is equal to the distance between the coupled magnetizer and detector on the outlet side, if magnetization is effected simultaneously on both the inlet and outlet sides, the magnetic mark on the outlet side always arrives earlier at the detector. Accordingly, in the present invention, by forming a gate pulse which is opened by the magnetic mark detection signal FIG. 1-(*d*) and closed after the lapse of a time determined by the line speed and the set range of the reduction ratio, that is, a gate pulse as shown in FIG. 1-(*e*), an erroneous detection pulse in the uncorrected detection pulse on the inlet side, as shown in FIG. 1-(*b*), is removed. The pulse time Tpu of the gate pulse shown in FIG. 1-(*e*) is set, for example, by the equation of $Tpu = Lx\ 1/v\ x\ 0.1$ (sec), in which L stands for the distance (m) between the magnetizer and detector and v stands for the line speed (m/sec), if the reduction ratio is about 10%.

Note, where the reduction ratio is very low and the detection timing (Pu in FIG. 1-(*c*)) of the magnetic mark on the outlet side is not sufficiently earlier than the detection timing of the magnetic mark on the inlet side, there is sometimes adopted a method in which the gate is opened at the time when the magnetic mark signal on the outlet side rises to the comparison level, that is, at the timing Pd shown in FIG. 1-(*c*).

If the gate is opened at the timing Pd, the rising of the gate pulse is Gd in FIG. 1-(*e*), and if the expansion of the magnetic mark at this time is $\pm d$ (m), the pulse time Tpd is expressed by the following equation:

Pulse time $Tpd = Tpu + d/v$ (sec)

If the detection signal on the inlet side is thus passed through the gate which is opened at the timing Pd or Pu to cause the gate pulse to rise at Gd or Gu and the logical product is taken, a signal as shown in FIG. 1-(*f*) is obtained, and the S/N ratio is improved and the risk of erroneous detection is moderated. According to the conventional technique, the measurement is impossible with respect to a soft material having a temper smaller than 4, but according to the apparatus of the present invention, the measurement is possible with respect to a soft material having a temper as small as 2.5 (corresponding to a Rockwell hardness $H_R$ of about 55).

Figure 2:
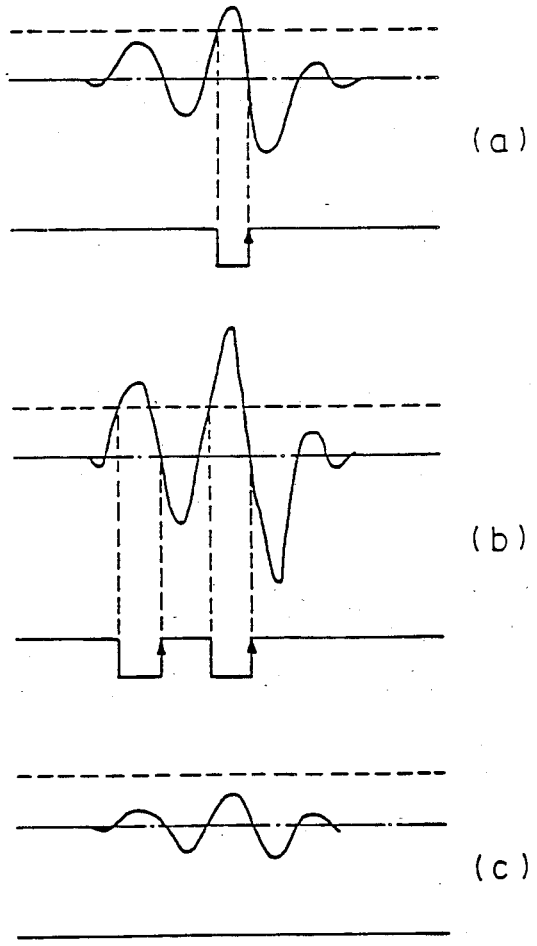
FIG. 2 is a diagram illustrating the relationship between the comparison level and the magnetic mark in the conventional apparatus.

The second characteristic feature of the present invention is that the comparison level of the detector is adjusted at each time. This feature will now be described in detail. In a continuous annealing-rolling line, in general, a method is adopted in which various products having different surface hardnesses are prepared, and a plurality of materials to be rolled are joined together by welding and fed to a rolling mill. It is known that the intensity of the magnetic mark is greatly changed according to the quality and hardness of the material to be rolled. Accordingly, where the comparison level of the detector is always kept constant, if the comparison level is a value appropriate to a magnetic mark of a certain intensity as shown in FIG. 2-(*a*), no problem arises, but if the intensity of the magnetic mark is changed as shown in FIG. 2-(*b*), an erroneous pulse is generated, and in the state shown in FIG. 2-(*c*), a detection pulse is not generated. According to the present invention, the comparison level is appropriately adjusted according to the intensity of the magnetic mark to eliminate this deficiency. As a means for removing the deficiency due to the change of the intensity of the magnetic mark, there can be considered a method in which the comparison level is appropriately changed based on a material quality signal received from a host computer. However, since the material quality signal is a target value for the product and is a generic value over the entire length of one product, in practice a local change cannot be detected, and the number of interface signals of the host computer is increased and the operation becomes complicated.

In the present invention, a method is adopted in which the peak values of a raw signal grasped between the magnetizer and detector for the preceding computation of the reduction ratio, that is, the magnitudes of the magnetic mark, are averaged according to the sample number by the computer and the comparison level is set, for example, at $\frac{2}{3}$ of the obtained peak value. Therefore, according to the present invention, the comparison level corresponding to the practical intensity of the magnetic mark is always appropriately set. Note, when the intensity of the magnetic mark on the inlet side is sampled, in order to know the true magnitude of the detection pulse, the peak value is sampled after passage through the gate shown in FIG. 1-(*e*).

Embodiments of the apparatus of the present invention will now be described in detail with reference to the accompanying drawings.

Figure 3:
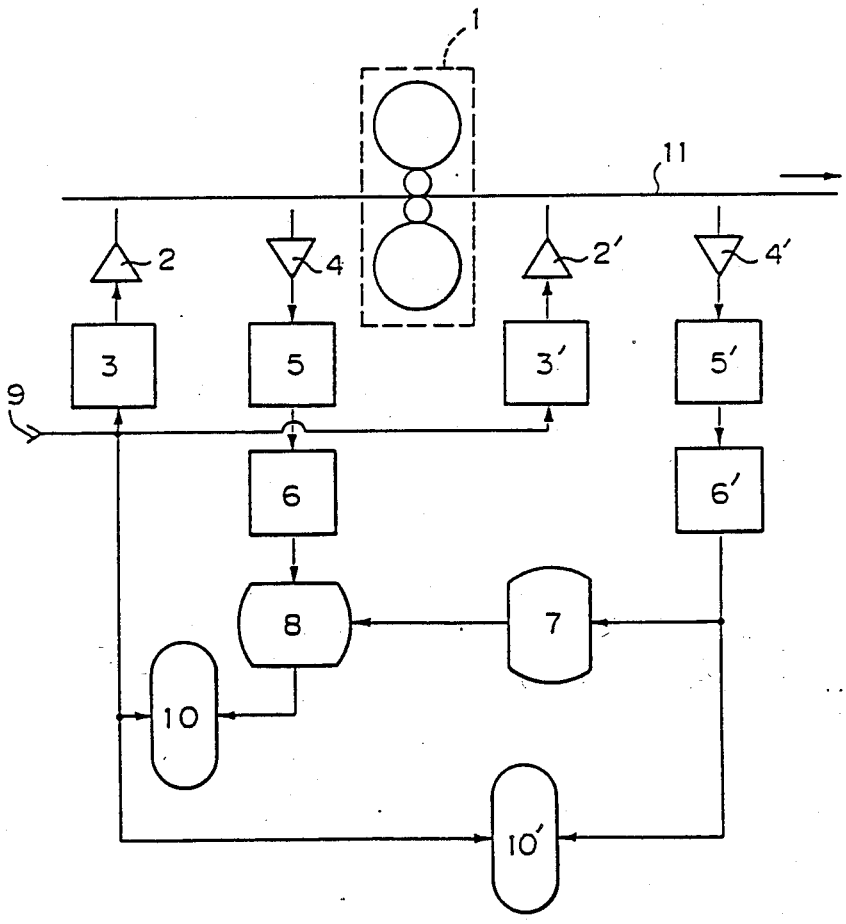
FIGS. 3 and 4 are block diagram illustrating the structures of embodiments of the present invention.

As shown in FIG. 3, magnetizing heads 2 and 2' and magnetizing units 3 and 3' are arranged on the inlet and outlet sides, and magnetic sensors 4 and 4' are arranged equidistantly downstream (in the direction of advance) from the magnetizing heads 2 and 2'. Amplifiers 5 and 5' and comparators 6 and 6' are connected to the magnetic sensors 4 and 4'.

In this apparatus, the magnetizing heads 2 and 2' are simultaneously actuated by a magnetizing instruction indicated by reference numeral 9 in the drawings to form a mark on a material 11 to be rolled. The magnetic mark is detected by the magnetic sensors 4 and 4' and detection pulses are obtained at the comparators 6 and 6'. As pointed out hereinbefore, the detection pulse of the comparator 6' has a high reliability but there is a great risk that the comparator 6 includes an erroneous detection pulse. Accordingly, the detection pulse of the comparator 6' is introduced into a gate generator 7 to generate a gate signal, an "AND" of the signal of a gate 8 and the detection pulse of the comparator 6 is taken, and this signal is fed to a counter 10 on the inlet side and is used as a stop pulse for the counter 10 on the inlet side. Namely, the counter 10 on the inlet side which has begun counting on receipt of the magnetizing instruction 9 is stopped by the signal which has passed through the gate 8. A counter 10' on the outlet side which has begun counting on receipt of the magnetizing instruction 9 is stopped by the signal from the comparator 6' on the outlet side. The reduction ratio of the material 11 is computed from the elapsing times read by the counters 10 and 10' on the inlet and outlet sides.

Figure 4:
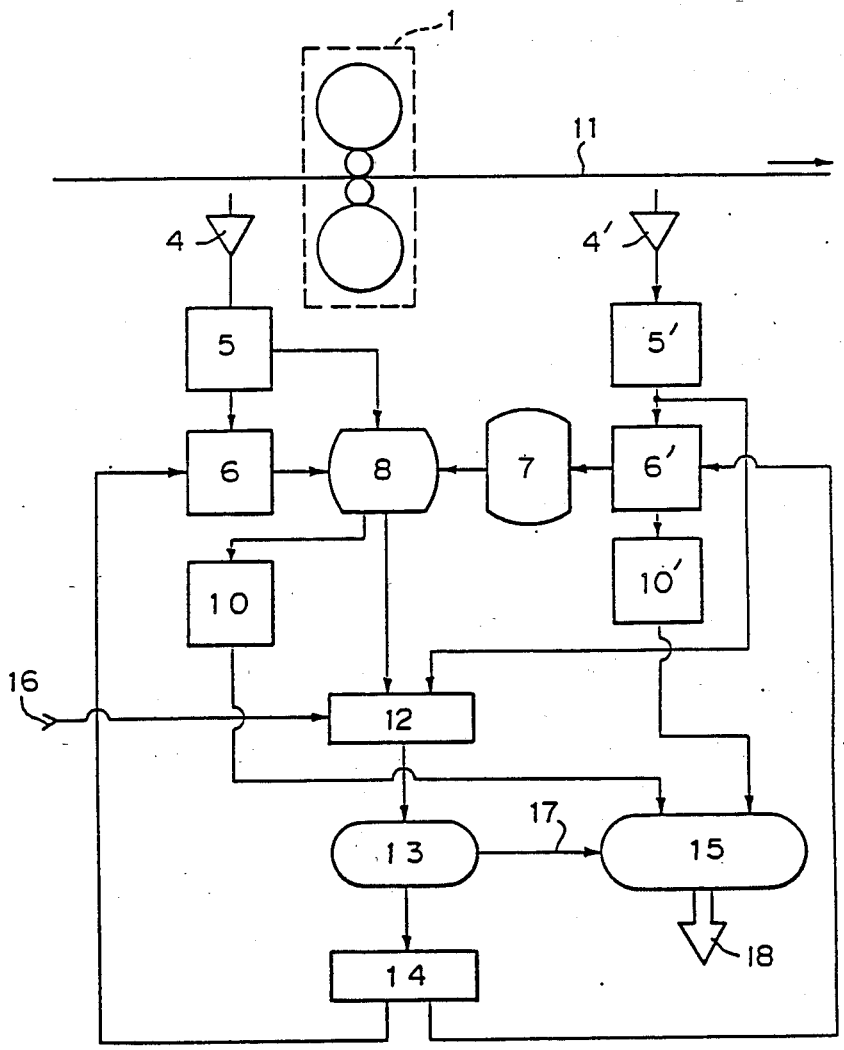

An embodiment of the means for adjusting the comparison level of the detector will now be described with reference to FIG. 4. Referring to FIG. 4, of the raw signals detected by the magnetic sensors 4 and 4' on the inlet and outlet sides and amplified by the amplifiers 5 and 5', the raw signal on the inlet side is passed through the gate 8 started by the detection pulse on the outlet side and sampled by an A/D converter 12 while the raw signal on the outlet side is directly sampled by the A/D converter, and the peak values are introduced into a computer, for example, sub-CPU 13, and are averaged according to the sample numbers on the inlet and outlet sides, respectively. Digital values corresponding to, for example, ⅔ of the respective mean values are computed by this sub-CPU 13 and are supplied to the comparators 6 and 6' on the inlet and outlet sides, respectively, as analog values of the comparison levels through a D/A converter 14. Of course, this conversion of the comparison levels is carried out during the operation of main CPU 15 for computation of the reduction ratio but is not carried out during the period of magnetization and detection for sampling of computation data, so that the operation for computation of the reduction ratio is not disturbed.

In the present embodiment, the line speed represented by reference numeral 16 is converted by the A/D converter 12 and is then taken into the sub-computer 13, and after simple computation, a sample number 17 optimal to the present line speed is interfaced in the main CPU 15, whereby the measurement precision and the controllability are reconciled in the apparatus. The line speed 16 can be easily measured in the apparatus from the distance between the magnetizer and detector and the elapsing time between the magnetization and the detection.

Figure 5:
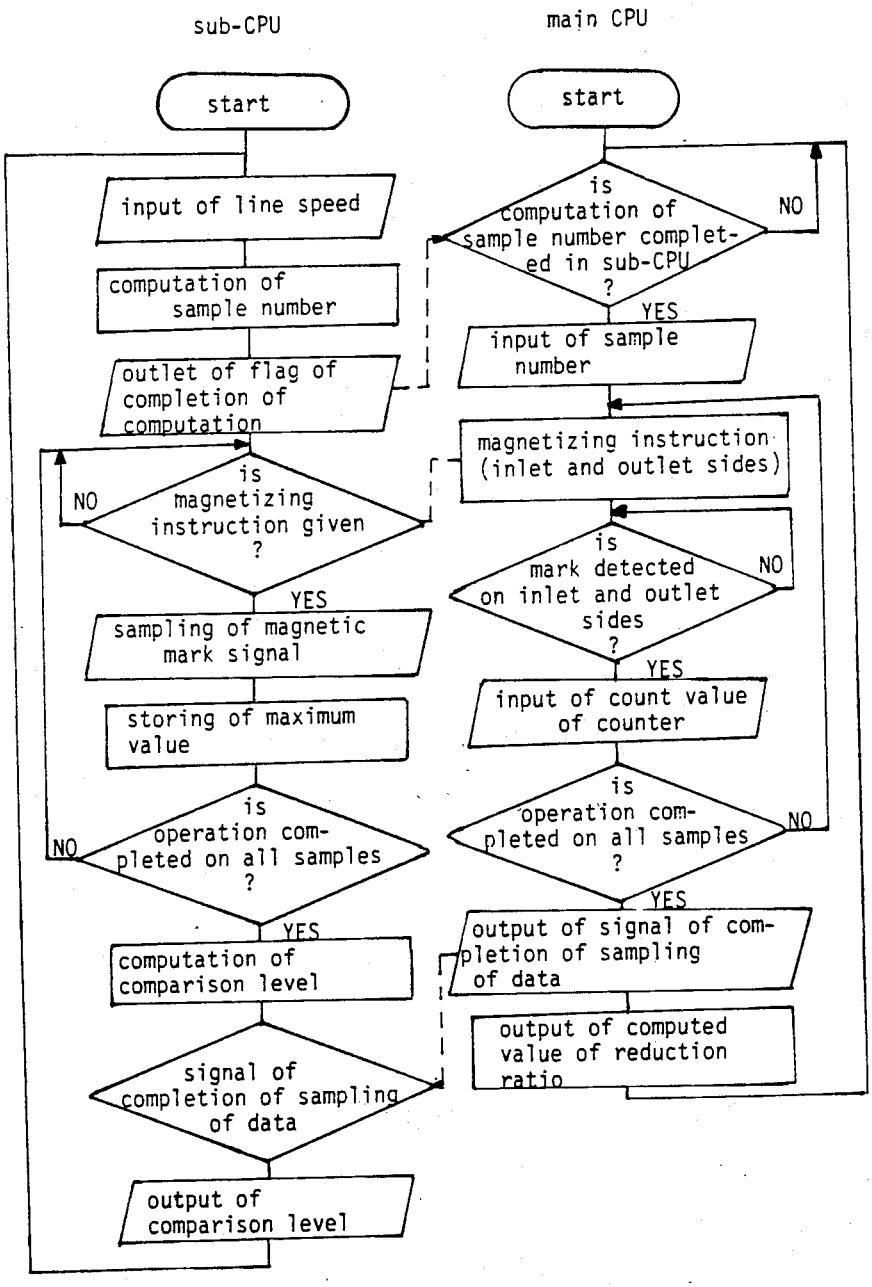
FIG. 5 is a flow chart showing the operation of the CPU in an embodiment of the present invention.

The operations of main CPU and sub-CPU in the embodiment of the present invention is illustrated in FIG. 5. By the operations shown in this flow chart, the main CPU shown in FIG. 4 controls the magnetization and detection, and the count values of the counters 10 and 10' are taken in the main CPU and averaged according to the sample number 17. After the precision is thus increased, the result of computation of the reduction ratio is put out as the output 18.

INDUSTRIAL APPLICABILITY

As is apparent from the foregoing description, according to the apparatus of the present invention, the defect of the conventional apparatus, where the S/N ratio is degraded on the inlet side because of the material or hardness of a material to be rolled or the local deformation on the surface and erroneous detection is readily caused, can be eliminated, an erroneous detection can be prevented and the detection level can be adjusted at each time according to the intensity of the present magnetic mark of the material to be rolled. Accordingly, an erroneous detection is not caused even if the quality or hardness of the material to be rolled is changed. Furthermore, although the measurement is impossible with respect to a soft material having a temper smaller than 4 according to the conventional technique, the measurement is possible even with respect to such a soft material as a steel sheet having a temper of 2.5, which is used for draw-forming of a juice can or the like, according to the present invention.

I claim:

1. An apparatus for measuring a reduction ratio of a rolled material from moving speeds of the material at inlet and outlet sides of a rolling mill, comprising:

an inlet magnetizing means and an output magnetizing means;

instructing means for providing magnetizing instructions, said inlet magnetizing means being disposed at the inlet and responsive to magnetizing instructions for forming a first magnetic mark on the material before being rolled in the rolling mill, said outlet magnetizing means being disposed at the outlet and responsive to the magnetizing instructions for forming a second magnetic mark on the material after being rolled in the rolling mill;

an inlet detecting means, coupled with said inlet magnetizing means, for detecting the first magnetic mark at a location which is a first predetermined distance from said inlet magnetizing means in a direction of movement of the material;

an outlet detecting means, coupled with said outlet magnetizing means, for detecting the second magnetic mark at a location which is a second predetermined distance from said outlet magnetizing means in the direction of movement of the material;

an inlet comparator means for comparing an output signal of said inlet detecting means to a first threshold;

an outlet comparator means for comparing an output signal of said outlet detecting means to a second threshold;

gate signal generating means, responsive to a detection signal from said outlet comparator means, for generating a gate signal when the output signal of said outlet detecting means exceeds the second threshold;

gate means, responsive to the gate signal and a detection signal from said inlet comparator means, for generating a stop signal indicative of a logical product value of the gate signal and the detection signal from said outlet comparator means;

first counter means, responsive to a first start signal of the magnetizing instructions for starting counting, and responsive to the stop signal for stopping counting, to obtain a first elapsed time; and second counter means, responsive to a second start signal of the magnetizing instructions for starting counting, and responsive to the detection signal from said outlet comparator means for stopping counting, to obtain a second elapsed time, whereby the speeds of movement of the magnetic marks at the inlet and outlet sides may be determined from the first and second elapsed times and the reduction ratio of the material may be computed from the speeds of movement.

2. An apparatus as in claim 1, further comprising means for calculating the speeds of movement of the magnetic marks at the inlet and outlet sides from the first and second elapsed times and for calculating the reduction ratio of the material from the speeds of movement.

3. An apparatus as in claim 2, wherein the first distance is equal to the second distance.

4. An apparatus as in claim 3, wherein the magnetizing instructions comprise an instruction signal, and the first and second stop signals are each equal to the instruction signal.

5. An apparatus as in claim 2, wherein the first distance is equal to the second distance.

6. An apparatus as in claim 5, wherein the magnetizing instructions comprise an instruction signal, and the first and second stop signals are each equal to the instruction signal.

7. An apparatus as in claim 1, wherein the magnetizing instructions comprise an instruction signal, and the first and second stop signals are each equal to the instruction signal.

* * * * *